US007651259B2

(12) United States Patent
Carrard et al.

(10) Patent No.: US 7,651,259 B2
(45) Date of Patent: Jan. 26, 2010

(54) WATCH WITH ROTATING ELEMENT

(75) Inventors: Bertrand Carrard, Bassecourt (CH); Sébastien Bolzt, Bienne (CH)

(73) Assignee: The Swatch Group Management Services AG, Biel (CH)

( * ) Notice: Subject to any disclaimer, the term of this patent is extended or adjusted under 35 U.S.C. 154(b) by 0 days.

(21) Appl. No.: 11/739,844

(22) Filed: Apr. 25, 2007

(65) Prior Publication Data

US 2007/0247978 A1 Oct. 25, 2007

(51) Int. Cl.
*G04B 29/00* (2006.01)

(52) U.S. Cl. ..... 368/319; 368/190

(58) Field of Classification Search ..... 368/319, 368/190–195, 146
See application file for complete search history.

(56) References Cited

U.S. PATENT DOCUMENTS

| | | | | | |
|---|---|---|---|---|---|
| 911,534 | A * | 2/1909 | Alford | 368/327 |
| 1,373,467 | A * | 4/1921 | Von Kersburg | 368/106 |
| 2,858,664 | A * | 11/1958 | Heimann | 368/194 |
| 3,269,107 | A * | 8/1966 | Morf | 368/191 |
| 3,358,438 | A * | 12/1967 | Simon | 368/289 |
| 3,443,375 | A * | 5/1969 | Cielaszyk | 368/185 |
| 3,690,061 | A * | 9/1972 | Humbert et al. | 368/192 |
| 3,785,141 | A * | 1/1974 | Ikegami | 368/21 |
| 5,155,712 | A * | 10/1992 | Mose et al. | 368/190 |
| 7,025,494 | B2 * | 4/2006 | Oomori et al. | 368/190 |
| 2002/0167866 | A1 | 11/2002 | Oomori et al. | |
| 2005/0162983 | A1 * | 7/2005 | Hirano et al. | 368/190 |

FOREIGN PATENT DOCUMENTS

| | | |
|---|---|---|
| CH | 229366 | 1/1944 |
| CH | 378232 | 2/1964 |
| DE | 197 25 884 A1 | 12/1998 |
| DE | 198 20 531 A1 | 11/1999 |
| EP | 1 560 082 A2 | 8/2005 |
| FR | 2.059.626 | 8/1970 |
| JP | 61-266988 | 11/1986 |

OTHER PUBLICATIONS

European Search Report issued in corresponding application No. EP 06 11 3065, completed Feb. 22, 2007.
Australian Search Report in corresponding Singapore application SG 200702947-3 completed Jun. 29, 2007 and mailed Jul. 10, 2007.

* cited by examiner

*Primary Examiner*—Vit W Miska
*Assistant Examiner*—Sean Kayes
(74) *Attorney, Agent, or Firm*—Griffin & Szipl, P.C.

(57) ABSTRACT

The invention concerns a timepiece including a case (10) and a crystal (22) together defining a housing (18) for a movement (20), and further including an element that is mobile in rotation (30) actuated by a control member (36) including a stem (42) of longitudinal axis AA, passing radially through said case (10), a crown (44) mounted on a first proximal end of said stem and a pinion (46) fixedly mounted in rotation on a second distal end of said stem (42). The control member (36) is fitted with a part (48) for axially securing said pinion (46) on said stem (42), arranged on the proximal side of said stem (42), said securing part (48) including:

a first slit ring (62) mounted so as to be locked axially and radially on a first of the pinion (46)/stem (42) elements, and means for axially locking the second of the pinion (46)/stem (42) elements, secured to said slit ring (62).

11 Claims, 3 Drawing Sheets

WATCH WITH ROTATING ELEMENT

This application claims priority from European Patent Application No. 06113065.4, filed Apr. 25, 2006, the entire disclosure of which is incorporated herein by reference.

FIELD OF THE INVENTION

The invention relates to the field of horology. It concerns more specifically a watch of the type including a rotating inner element fitted with a control member that can be actuated from the exterior of the case.

BACKGROUND OF THE INVENTION

Such watches are known and marketed. They are, conventionally, dive watches comprising a rotating inner bezels. One can also find watches whose dial rotates in order to create an aesthetic or surprising effect, or watches fitted with a rotating polarizer inserted between the dial and the crystal.

Whatever the type of rotating element, it is actuated using a control member accessible from the exterior of the case. This type of control member is generally formed of a stem passing through the case radially, a crown secured to the outer end of the stem and a pinion secured to its inner end. An assembly of this type is illustrated in FIG. 1, which shows a partial cross-section of a watch comprising a mobile element.

The watch shown in FIG. 1 comprises, in a conventional manner, a case 10 formed of a middle part 12, a cap 14 and a back cover 16 together defining a housing 18 in which a movement 20 is mounted. A crystal 22 closes the case 10 in a water resistant manner. A dial 24 is mounted on movement 20. A circular recess 26 made in middle part 12 forms a shoulder 28 at the height of dial 24. A rotating bezel 30, inserted between dial 24 and crystal 22, is partially housed in circular recess 26, which axially positions and guides the latter in rotation. The bottom face of rotating bezel 30 includes a first flat circular portion 32*a* arranged opposite the periphery of dial 24 so as to conceal the same, and a second flat circular portion 32*b* abutting shoulder 28. It further comprises an intermediate circular portion 32*c* located between the first and second flat portions 32*a* and 32*b* and forming a contrate toothing 34.

A control member 36 actuates rotating bezel 30. For this purpose, a hole 38 passes radially through middle part 12. An intermediate tube 40 having a particularly well-finished inner surface state is screwed inside hole 38. A stem 42 of longitudinal axis AA is mounted inside tube 40 such that the ends thereof project outside and inside case 10. A crown 44 is secured to a first proximal end, whereas a pinion 46 is secured to a second distal end. The stem 42-crown 44-pinion 46 assembly forms the control member 36 of bezel 30. The latter is arranged in middle part 12 such that pinion 46 meshes with contrate toothing 34. The rotation of crown 44 actuated by the user, thus causes bezel 30 to rotate inside case 10.

Pinion 46 is secured to the distal end of stem 42 by screws and by bonding. This method of securing pinion 46 guarantees the axial and angular positioning of the latter relative to stem 42, which allows the transmission of the rotational movement of the control member 36 to bezel 30. However, it will be observed that such a method of securing by screws and bonding is so strong that it is practically definitive. During a maintenance service, it is almost impossible to dismantle control member 36 without breaking stem 42. A simple solution to this problem consists in using a stem 42 whose end, having a square cross-section, is engaged in a hole in pinion 46 that also has a square cross-section. Pinion 46 is thus locked angularly. Axial positioning can be achieved using a circlip arranged at the end of stem 42, in a groove located in immediate proximity to pinion 46, on the distal side. In order to do this, stem 42 must be slightly longer than in the case of securing by screws-bonding, which cannot be envisaged because of the lack of space between pinion 46 and movement 20.

The invention overcomes this difficulty by proposing the use of a securing part that is arranged, not on the movement side, as in the previously proposed solution, but on middle part 12 side. This securing part is anchored in stem 42 and pinion 46 in order to position pinion 46 axially.

SUMMARY OF THE INVENTION

More specifically, the invention concerns a timepiece comprising a case and a crystal together defining a housing for a movement, and further comprising an element that can move in rotation actuated by a control member including a stem of longitudinal axis AA passing radially through the case, a crown mounted on a first proximal end of the stem and a pinion fixedly mounted in rotation on a second distal end of the stem, characterized in that the control member is fitted with a part for axially securing the pinion on the stem, arranged on the proximal side of the stem, the securing part including:

- a slit ring mounted to be locked axially and radially on a first of the pinion/stem elements, and
- axial locking means for the second of the stem/pinion elements, secured to the slit ring.

Because of the securing part arranged on the proximal side of stem 42, control member 36 of the rotating element can be disassembled and reassembled without any risk of breaking stem 42.

BRIEF DESCRIPTION OF THE DRAWINGS

Other features and advantages of the present invention will appear more clearly from the following detailed description of an example embodiment of a watch according to the invention, this example being given purely by way of non-limiting illustration, with reference to the annexed drawings, in which.

DETAILED DESCRIPTION OF THE ILLUSTRATIVE EMBODIMENTS

Figure 1:
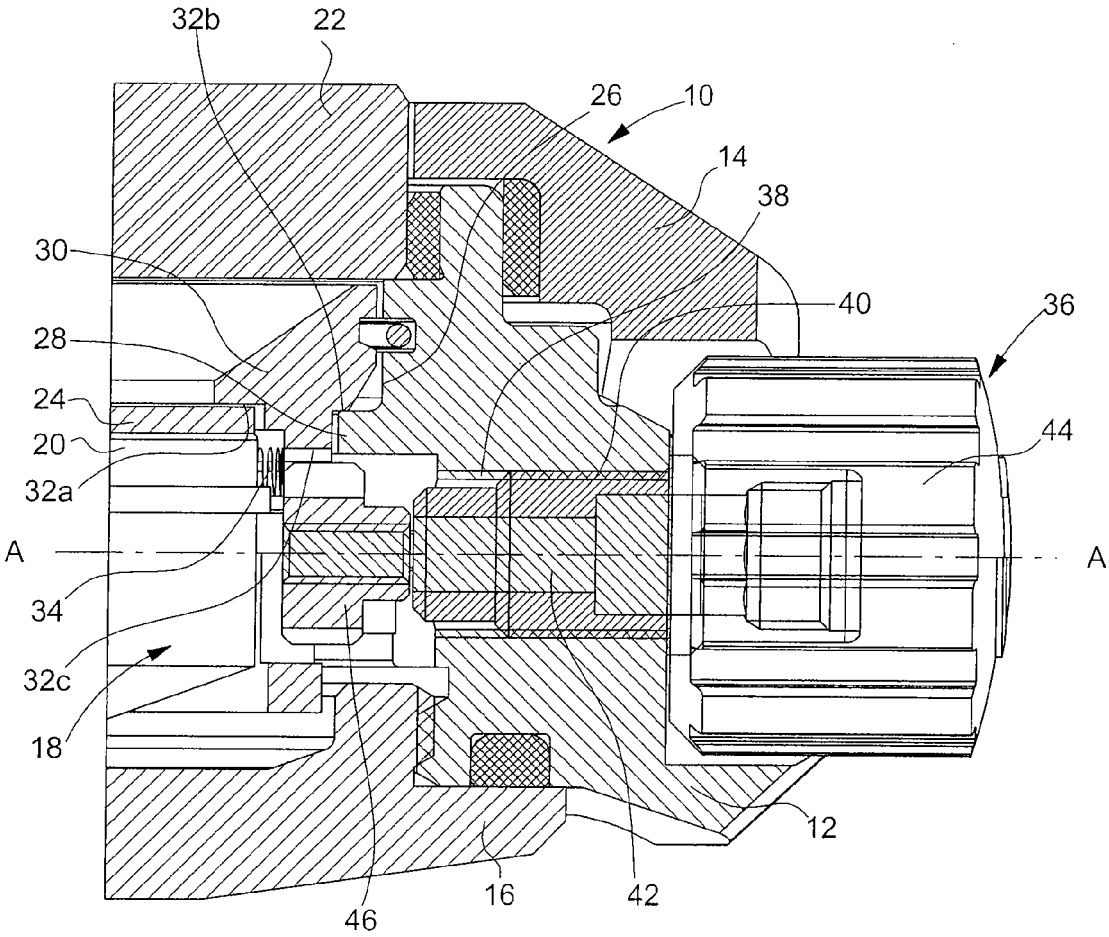
PRIOR ART Fig. 1
FIG. 1 illustrates a partial cross-section of a conventional watch comprising a mobile element.
Figure 2:
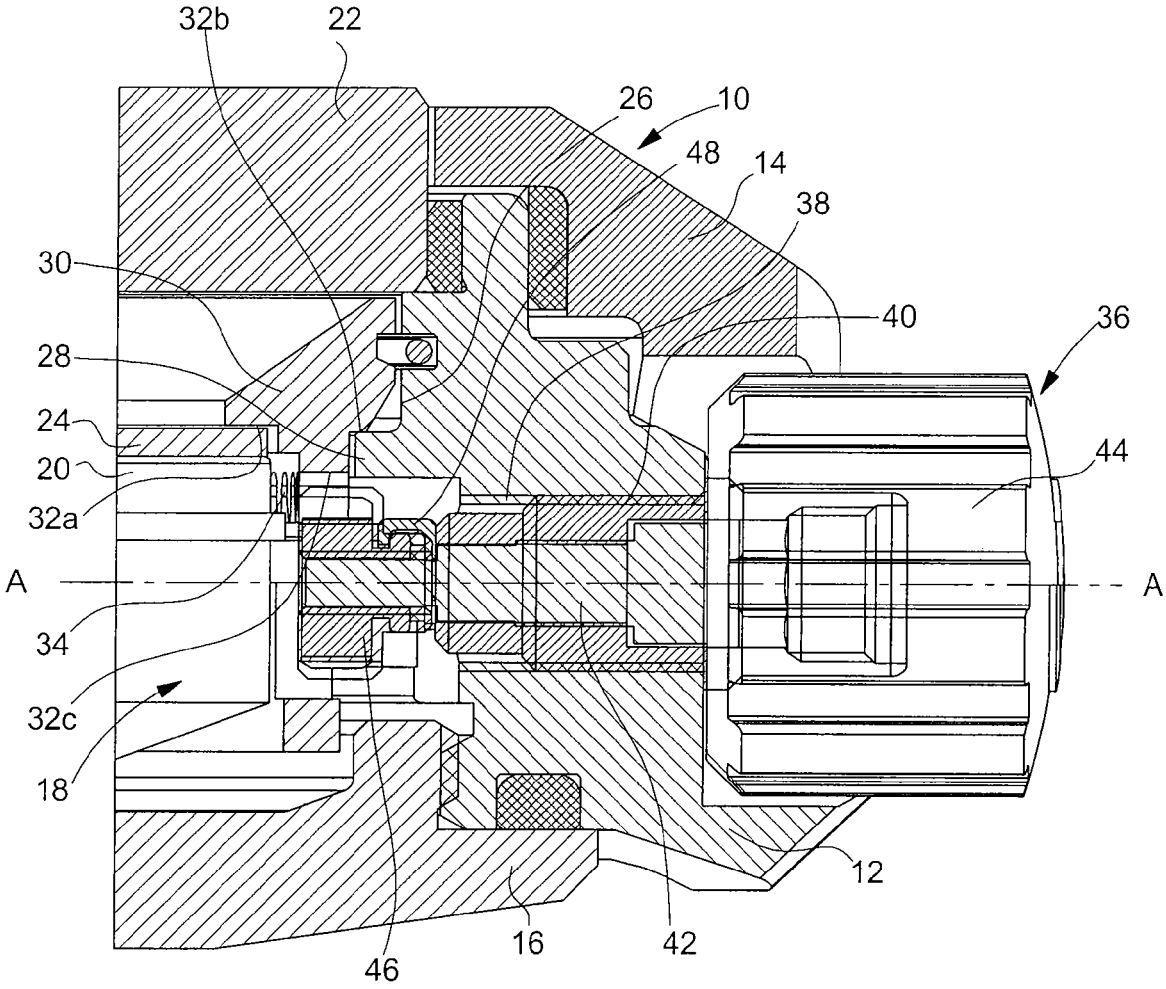
FIG. 2 illustrates an exploded partial cross-section of a watch according to the invention.

The watch shown in FIG. 2 comprises, like the watch shown in FIG. 1, a case 10 formed of a middle part 12, a cap 14 and a back cover 16 together defining a housing 18 in which a movement 20 is mounted. A crystal 22 closes case 10 in a water resistant manner. A dial 24 is mounted on movement 20. A rotating bezel 30 fitted with a contrate toothing 34 is inserted between dial 24 and crystal 22. It is actuated by a control member 36, comprising a stem 42, a crown 44 and a pinion 46.

The watch shown in FIG. 2 differs from the watch shown in FIG. 1 in that pinion 46 is not screwed and bonded to the inner end of stem 42. In fact, pinion 46 is fixedly mounted in rotation on the end of stem 42. A removable securing part 48, located on the proximal side of stem 42, is anchored in stem 42 and pinion 46 so as to position the latter axially. Securing part 48 is also abutting on intermediate tube 40 such that it opposes any axial movement of stem 42 towards the exterior of middle part 12.

Figure 3:
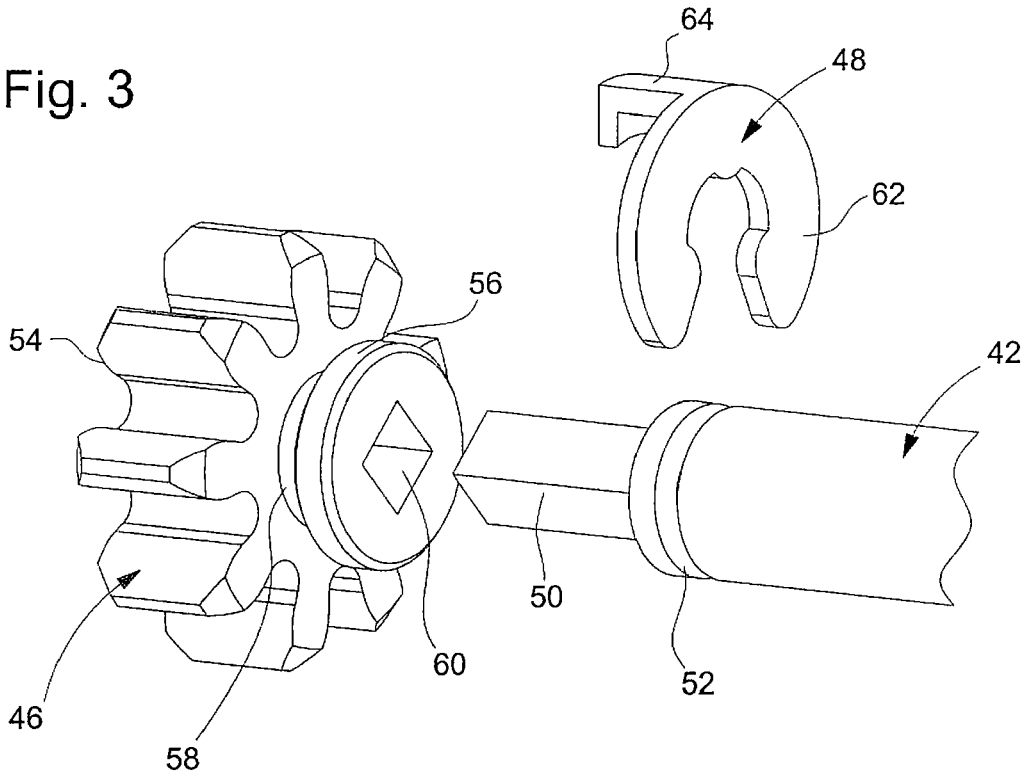
FIG. 3 shows an exploded partial view of an advantageous embodiment of a control member present in the watch according to the invention.

The structure of control member 36 fitted to the watch according to the invention and, in particular, the method of securing pinion 46 to stem 42, appear more clearly in FIG. 3. The distal end 50 of stem 42 has a square cross-section. A circular groove 52 is made in proximity to end 50. Pinion 46 includes a toothed portion 54 for cooperating with contrate toothing 34, and a short stem 56 in which a circular groove 58 is made. Pinion 46 is pierced with a central hole 60 of square cross-section, such that pinion 46 is angularly and radially positioned in relation to stem 42. Of course, any other shaped cross-section allowing transmission of torque, such as a triangular or hexagonal cross-section, could be employed.

Securing part 48 is formed of a ring 62 and an L-shaped rigid arm 64 secured to ring 62 and extending axially from the periphery thereof. Ring 62 is slit so as to have a certain radial flexibility, the slot flaring slightly outwards. This feature facilitates assembly of ring 52 by pressure on a cylindrical part. Ring 62 is mounted in groove 52 such that it is positioned axially and radially on stem 42. The L-shaped rigid arm 64 is then engaged in groove 58, which has the effect of locking pinion 46 axially. Thus mounted, control member 36 can fulfil the function of transmitting the rotational movement from crown 44 to rotating bezel 30, while being easy to disassemble.

Figure 4:
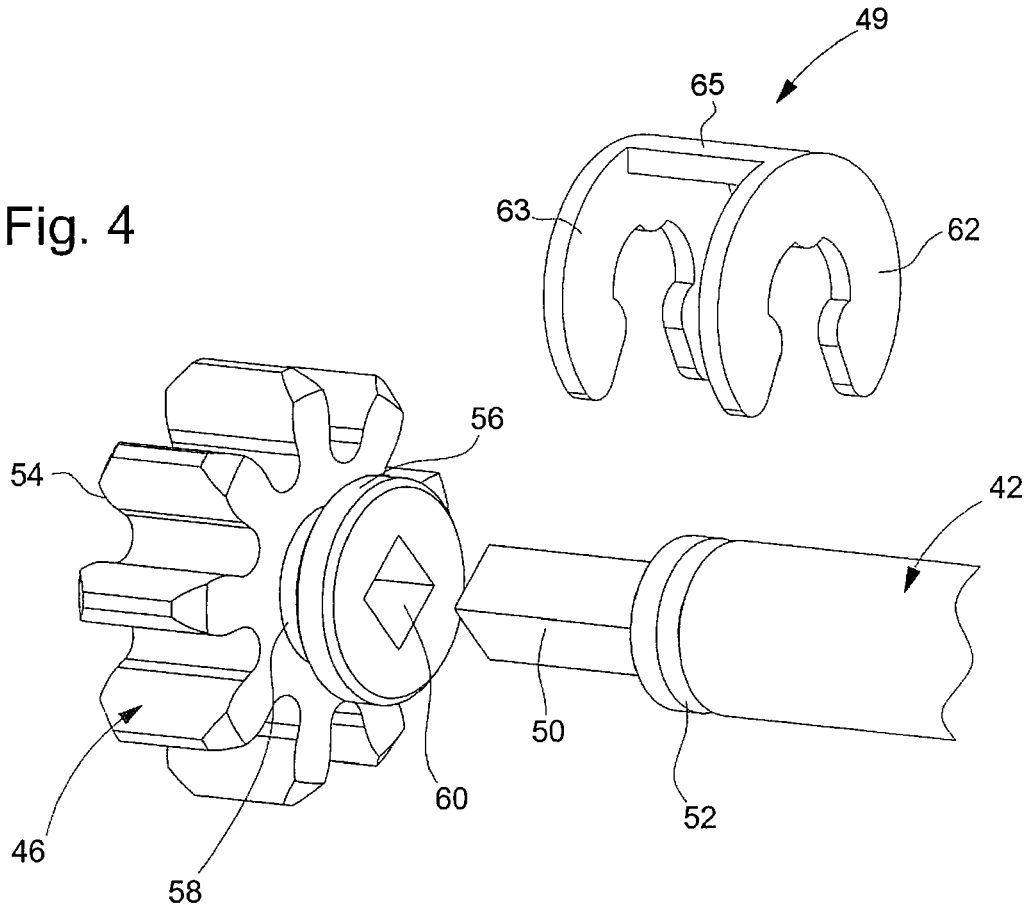
FIG. 4 shows an exploded partial view of an embodiment of a control member present in the watch, wherein the locking means are formed of a second slit ring connected to the first slit ring by a rigid arm.

FIG. 4 shows an exploded partial view of an embodiment similar to that shown in FIG. 3 but with an alternate securing part 49, wherein the L-shaped rigid arm is replaced by a second slit ring 63 that is connected to the first slit ring 62 by a rigid arm 65. The second slit ring 63 mounts in a circular groove 58.

Of course, the watch according to the invention is not limited to the embodiment that has just been described and various simple alterations and variants can be envisaged by those skilled in the art without departing from the scope of the invention as defined by the annexed claims.

It will be noted, for example, that circular groove 58 could be replaced by a simple hollow in which the L-shaped arm 64 engages. In a second variant, the securing part could be formed of two rings of the same type as ring 62, connected to each other by a rigid arm. In a third variant, end 50 and short stem 56 could be pierced with a hole perpendicular to axis AA of stem 42. The L-shaped arm 64 would then be formed of a rigid portion extending axially and a stem extending radially into the holes made in end 50 and stem 56. Finally, it will be noted that control member 36 can actuate any rotating element, such as a bezel, a dial or a polarizer.

What is claimed is:

1. A timepiece including:

(a) a case and a crystal together defining a housing for a movement; and (b) an element that is mobile in rotation actuated by a control member including i. a stem with a longitudinal axis passing radially through said case;

ii. a crown mounted on a first proximal end of said stem; and iii. a pinion fixedly mounted in rotation on a second distal end of said stem during operation of said timepiece, wherein said control member is fitted with a securing part that axially secures said pinion on said stem, wherein said securing part is arranged on a proximal side of said stem, and said securing part includes (1) a first slit ring mounted so as to be locked axially and radially on the pinion of the element; and (2) means for axially locking the stem of the element, wherein the means for axially locking the stem of the element is secured to said slit ring.

2. The timepiece according to claim 1, wherein said slit ring is mounted in a circular groove made in the pinion of the element.

3. The timepiece according to claim 1, wherein said axial locking means are formed of an L-shaped arm.

4. The timepiece according to claim 3, wherein said L-shaped arm is engaged in a hollow made in the stem of the element.

5. The timepiece according to claim 4, wherein said hollow is a circular groove.

6. The timepiece according to claim 1, wherein said locking means are formed of a second slit ring connected to said first slit ring by a rigid arm.

7. The timepiece according to claim 6, wherein said second slit ring is mounted in a circular groove made in the stem of the element.

8. The timepiece according to claim 1, wherein said stem includes one end with a square cross-section and in that said pinion is pierced with a hole of square cross-section in which said end is engaged.

9. A timepiece, including:

(a) a case and a crystal, together defining a movement housing;

(b) a rotatable element; and (c) a control member including i. a stem defining a longitudinal axis passing radially through the case, wherein the control member is rotationally engaged with the rotatable element;

ii. a crown mounted on a first end of the stem; and iii. a pinion fixedly mounted in rotation on a second end of the stem during operation of the timepiece, wherein the control member is fitted with a securing part axially securing the pinion on the second end of the stem, the securing part including (1) a first slit ring mounted so as to be locked axially on one of the pinion or the stem; and (2) means for axially locking the securing part to the other one of the pinion or the stem, wherein the means for axially locking is secured to the slit ring.

10. A timepiece including:

(a) a case and a crystal together defining a housing for a movement; and (b) an element that is mobile in rotation actuated by a control member including i. a stem with a longitudinal axis passing radially through said case;

ii. a crown mounted on a first proximal end of said stem; and iii. a pinion fixedly mounted in rotation on a second distal end of said stem, wherein said control member is fitted with a securing part that axially secure said pinion on said stem, wherein said securing part is arranged on a proximal side of said stem, and said securing part includes (1) a first slit ring mounted so as to be locked axially and radially on one of the pinion or the stem of the element; and (2) means for axially locking the other one of the pinion or the stem of the element, wherein the means for axially locking is secured to said slit ring, wherein said securing part allows the control member to be disassembled and reassembled without any risk of breaking said stem.

11. A timepiece including:

(a) a case and a crystal together defining a housing for a movement; and (b) an element that is mobile in rotation actuated by a control member including i. a stem with a longitudinal axis passing radially through said case;

ii. a crown mounted on a first proximal end of said stem; and iii. a pinion fixedly mounted in rotation on a second distal end of said stem during operation of said timepiece, wherein said control member is fitted with a securing part that axially secures said pinion on said stem, wherein said securing part is arranged on a proximal side of said stem, and said securing part includes (1) a first slit ring mounted so as to be locked axially and radially on the stem of the element; and (2) means for axially locking the pinion of the element, wherein the means for axially locking the pinion of the element is secured to said slit ring.

* * * * *

UNITED STATES PATENT AND TRADEMARK OFFICE

CERTIFICATE OF CORRECTION

PATENT NO. : 7,651,259 B2
APPLICATION NO. : 11/739844
DATED : January 26, 2010
INVENTOR(S) : Bertrand Carrard et al.

It is certified that error appears in the above-identified patent and that said Letters Patent is hereby corrected as shown below:

Title Page, insert

-- (30) Foreign Application Priority Data
April 25, 2006 (EP) ..... 06113065.4 --.

Signed and Sealed this
Fifth Day of July, 2011

David J. Kappos

David J. Kappos
*Director of the United States Patent and Trademark Office*